US006089571A

United States Patent [19]

Cho

[11] Patent Number: 6,089,571

[45] Date of Patent: Jul. 18, 2000

[54] ELECTRIC DART GAME

[76] Inventor: Kunlin Cho, 7F., No. 322, Sec. 3, Fu Hsin Road, Taichung, Taiwan

[21] Appl. No.: 08/943,261

[22] Filed: Oct. 3, 1997

[30] Foreign Application Priority Data

Aug. 1, 1997 [TW] Taiwan ..... 86213205

[51] Int. Cl.[7] ..... F41J 5/04

[52] U.S. Cl. ..... 273/371; 273/374; 273/376; 463/49

[58] Field of Search ..... 463/49–57; 273/371–379, 273/398, 403, 404, 408, 406, 407, 348

[56] References Cited

U.S. PATENT DOCUMENTS

| | | | |
|---|---|---|---|
| 4,057,251 | 11/1977 | Jones et al. | 273/376 |
| 4,561,660 | 12/1985 | Zammuto | 273/376 |
| 4,635,940 | 1/1987 | Kelley | 273/347 |
| 4,651,998 | 3/1987 | Holt et al. | 273/347 |
| 4,706,962 | 11/1987 | Michalski | 273/347 |
| 4,836,556 | 6/1989 | DeVale et al. | 273/376 |
| 4,976,441 | 12/1990 | Kim | 273/376 |
| 5,004,247 | 4/1991 | Menke | 273/376 |
| 5,116,063 | 5/1992 | Harlan et al. | 273/376 |
| 5,193,817 | 3/1993 | Pan | 273/376 |
| 5,275,418 | 1/1994 | Yiu | 273/376 |
| 5,518,250 | 5/1996 | Lu et al. | 273/347 |
| 5,560,617 | 10/1996 | Liang | 273/376 |
| 5,601,290 | 2/1997 | Yiu | 273/376 |
| 5,613,685 | 3/1997 | Stewart et al. | 273/374 |
| 5,626,344 | 5/1997 | Huang | 273/376 |
| 5,718,433 | 2/1998 | Lu et al. | 273/374 |
| 5,788,244 | 8/1998 | Hui et al. | 273/374 |
| 5,848,792 | 12/1998 | Brejcha | 273/376 |

FOREIGN PATENT DOCUMENTS

| | | | |
|---|---|---|---|
| 0495539 | 7/1992 | European Pat. Off. | 273/408 |
| 4004409 | 8/1991 | Germany | 273/408 |
| 2130107 | 5/1984 | United Kingdom | 273/376 |

*Primary Examiner*—Valencia Martin-Wallace
*Assistant Examiner*—John M Hotaling, II
*Attorney, Agent, or Firm*—Connolly Bove Lodge & Hutz LLP

[57] ABSTRACT

An electric dart game includes a frame secured in a board and having a number of segments slidably engaged in a number of scoring areas. A plate and a spider are secured to the frame. Two conductor sheets are disposed behind the plate and each includes a circuit having a series of switch points. The segments each includes a slide and a block secured together. The slides each has one or more hooks for engaging with the frame and for preventing the slide from being disengaged from the frame. The slides and the blocks may be easily assembled without additional fasteners.

7 Claims, 7 Drawing Sheets

ELECTRIC DART GAME

BACKGROUND OF THE INVENTION

1. Field of the Invention

The present invention relates to a dart game, and more particularly to an electric dart game.

2. Description of the Prior Art

Typical electric dart games comprise a board including a number of segments slidably engaged in a number of scoring areas for being shot by the darts. However, the segments each is required to be secured in place by fasteners such that the electric dart game may not be easily assembled. In addition, the segments each includes a number of holes for engaging with the darts. However, the darts may shot onto the partitions between the holes and may rebound easily.

The present invention has arisen to mitigate and/or obviate the afore-described disadvantages of the conventional electric dart games.

SUMMARY OF THE INVENTION

The primary objective of the present invention is to provide an electric dart game which includes a number of segments that may be assembled without additional fasteners.

In accordance with one aspect of the invention, there is provided an electric dart game comprising a board, a frame secured in the board and including a plurality of scoring areas, the frame including a front portion and a rear portion, a plurality of segments slidably engaged in the scoring areas and provided for being shot by a dart, a plate secured to the rear portion of the frame and including a plurality of orifices and apertures, a spider including a circumferentially and radially extending ribs for securing to the front portion of the frame and for engaging with the segments and for preventing the segments from being disengaged from the scoring areas of the frame, two conductor sheets disposed behind the plate and each including a circuit having a series of switch points interconnected by a series of conductor lines, and a nonconducting and apertured sheet disposed between the conductor sheets and including a plurality of punctures aligned with the switch points for allowing the switch points to be contacted with each other. The segments each includes a slide slidably engaged in the scoring area of the frame and each includes a block secured to the slide and provided for being shot by the dart, the slides each includes at least one hook slidably engaging through the orifice of the plate and for engaging with the frame and for limiting a relative movement of the slide relative to the frame and for preventing the slide from being disengaged from the frame, and the slides each includes at least one leg slidably engaging with the aperture of the plate for contacting the switch points together when the block is shot by the dart.

A spring means is further provided for biasing the slides and the blocks away from the plate and for biasing the blocks outward of the frame.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
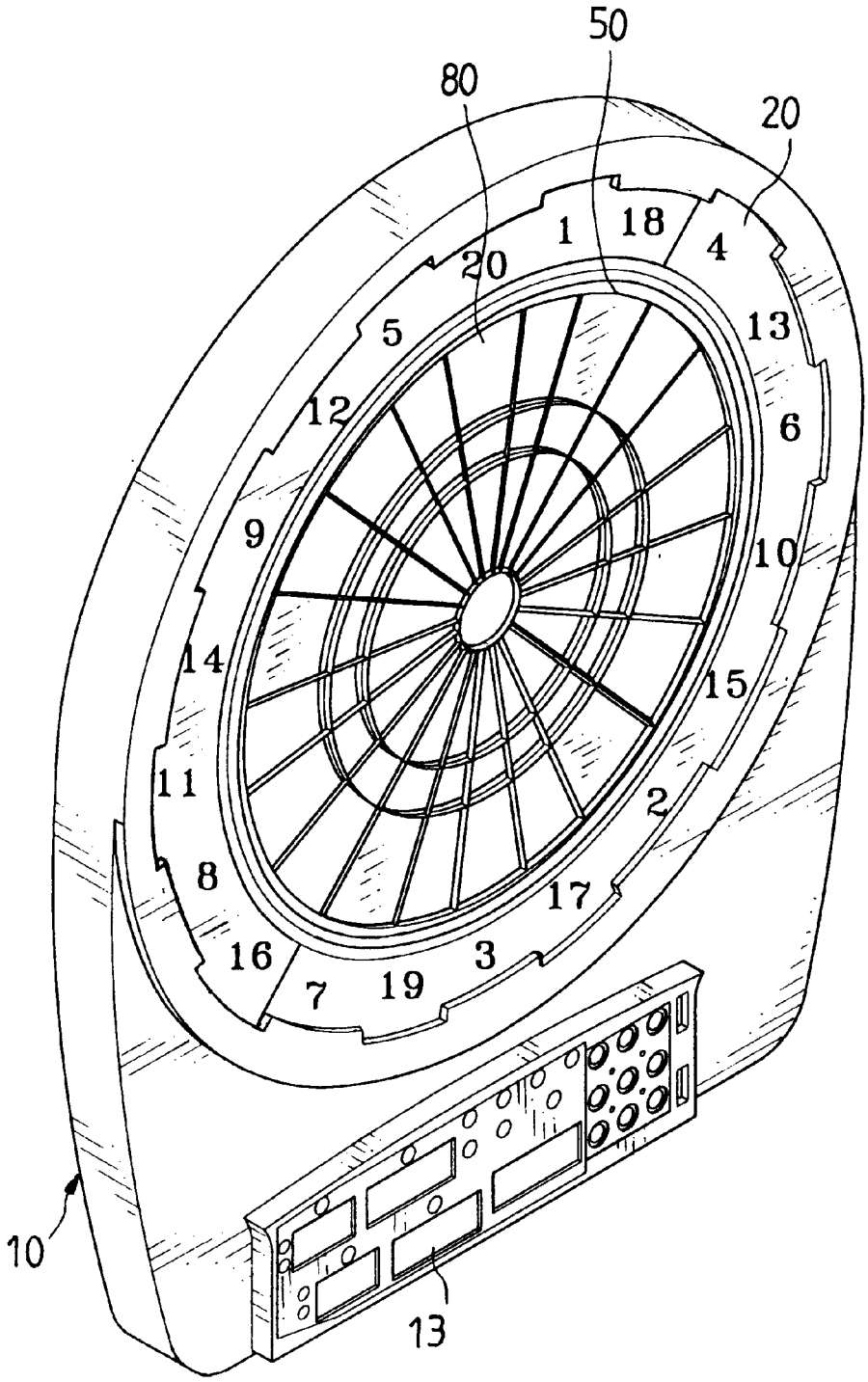
FIG. 1 is a perspective view of an electric dart game in accordance with the present invention.
Figure 2:
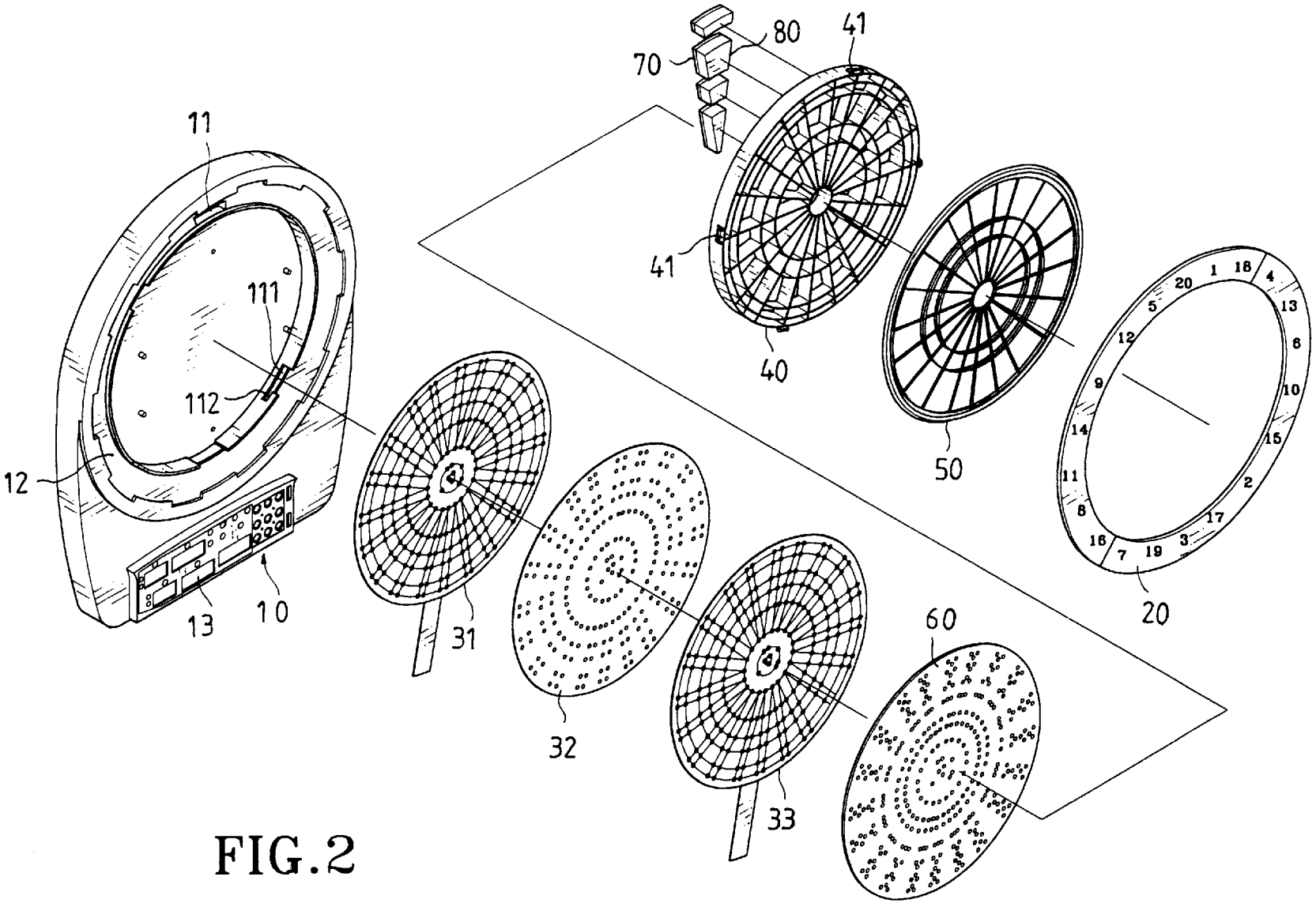
FIG. 2 is an exploded view of the electric dart game.

Referring to the drawings, and initially to FIGS. 1 and 2, an electric dart game in accordance with the present invention comprises a board 10 including an annular flange 11 having a front portion 12 for securing a ring 20. A number of scores may be printed or applied onto the ring 20 for scoring purposes. The annular flange 11 includes a number of notches 111 and recesses 112 formed in the radially inward peripheral portion. The board 10 includes a rear wall 110 and includes one or more displayers 13, such as liquid crystal display (LCD) or light emitting diode (LED), provided on the bottom portion for displaying the scores of the players.

Figure 3:
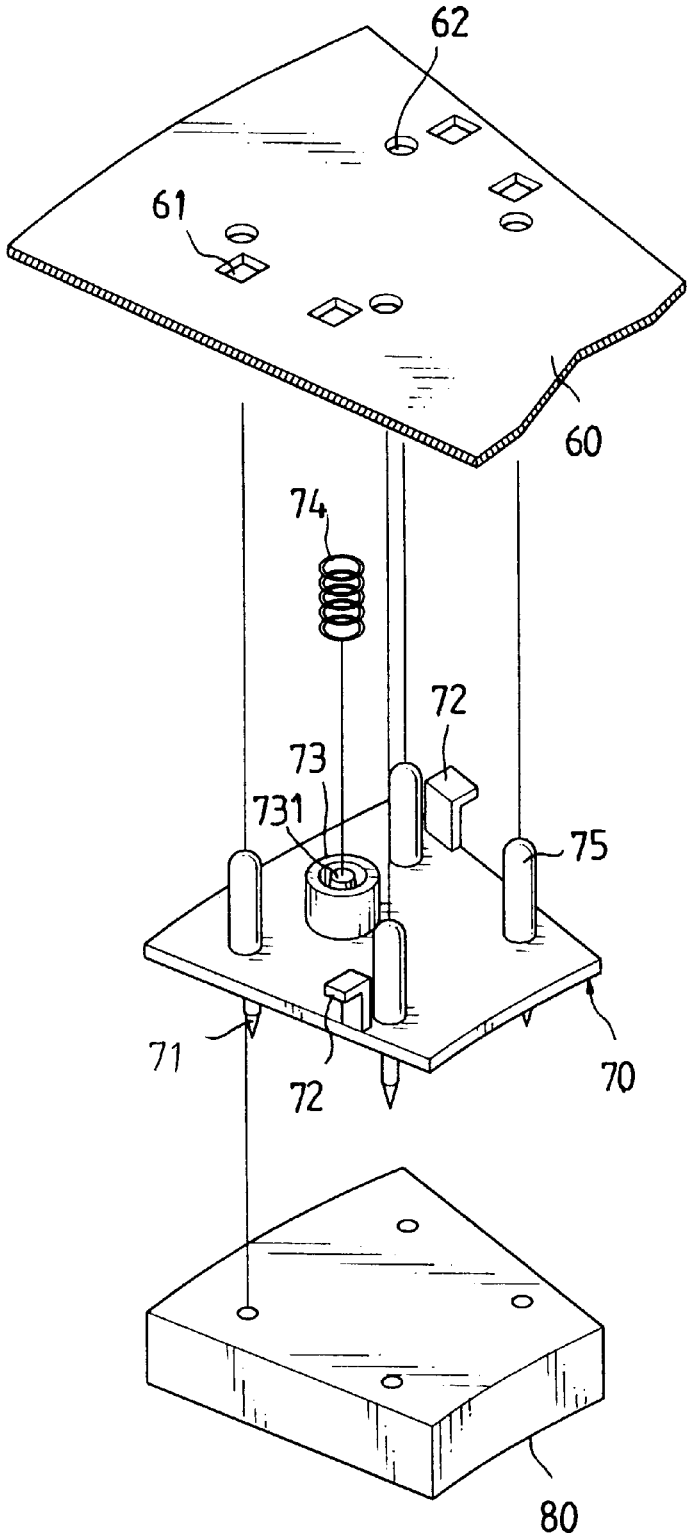
FIG. 3 is a partial exploded view of the segment for the electric dart game, in which the segment is shown up side down.

A frame 40 includes a number of projections 41 extended radially outward for engaging with the notches 111 of the board 10 and for engaging with the recesses 112 and for securing the frame 40 to the board 10 after the frame 40 is rotated relative to the board 10 for a small angle. The frame 40 includes a number of scoring areas 42 for slidably receiving a number of segments 70, 80 respectively. A spider 50 includes a circumferentially and radially extending ribs 51 for securing to the frame 40 by such as molding process or by adhesive material, and includes a number of openings 52 communicating with the scoring areas 42 of the frame 40. The ribs 51 of the spider 50 each preferably includes a triangular configuration having bottom portion for engaging with the segments 70, 80 and for preventing the segments from being disengaged from the frame 40. A plate 60 is secured to the rear portion of the frame 40 and includes a number of orifices 61 and apertures 62 (FIG. 3).

Figure 4:
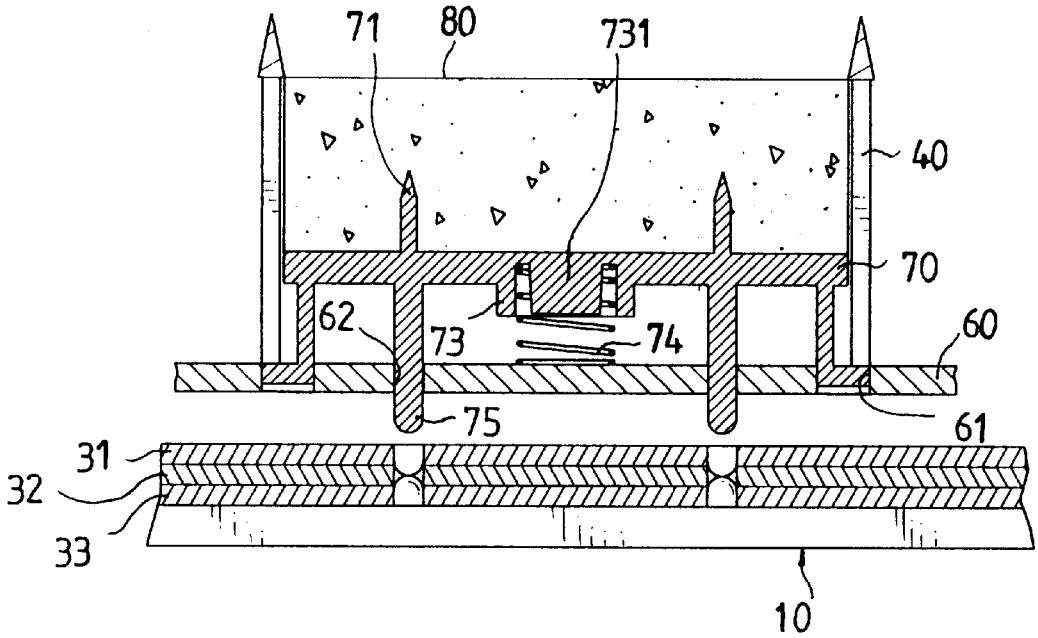
FIGS. 4, 5, 6 are cross sectional views illustrating the operation of the segment.
Figure 5:
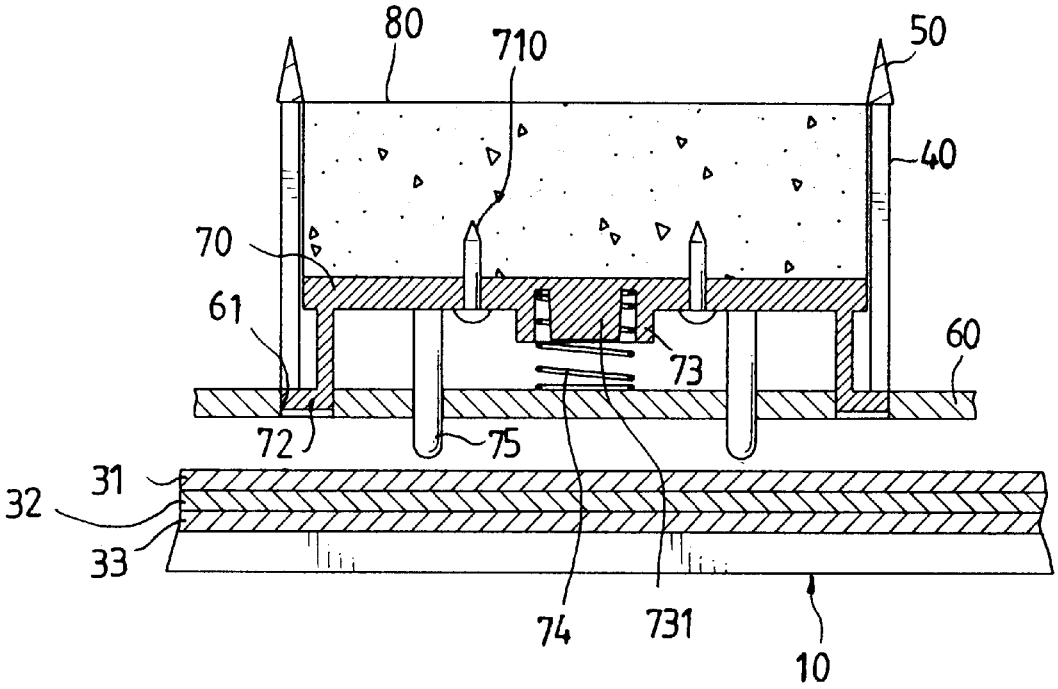
Figure 6:
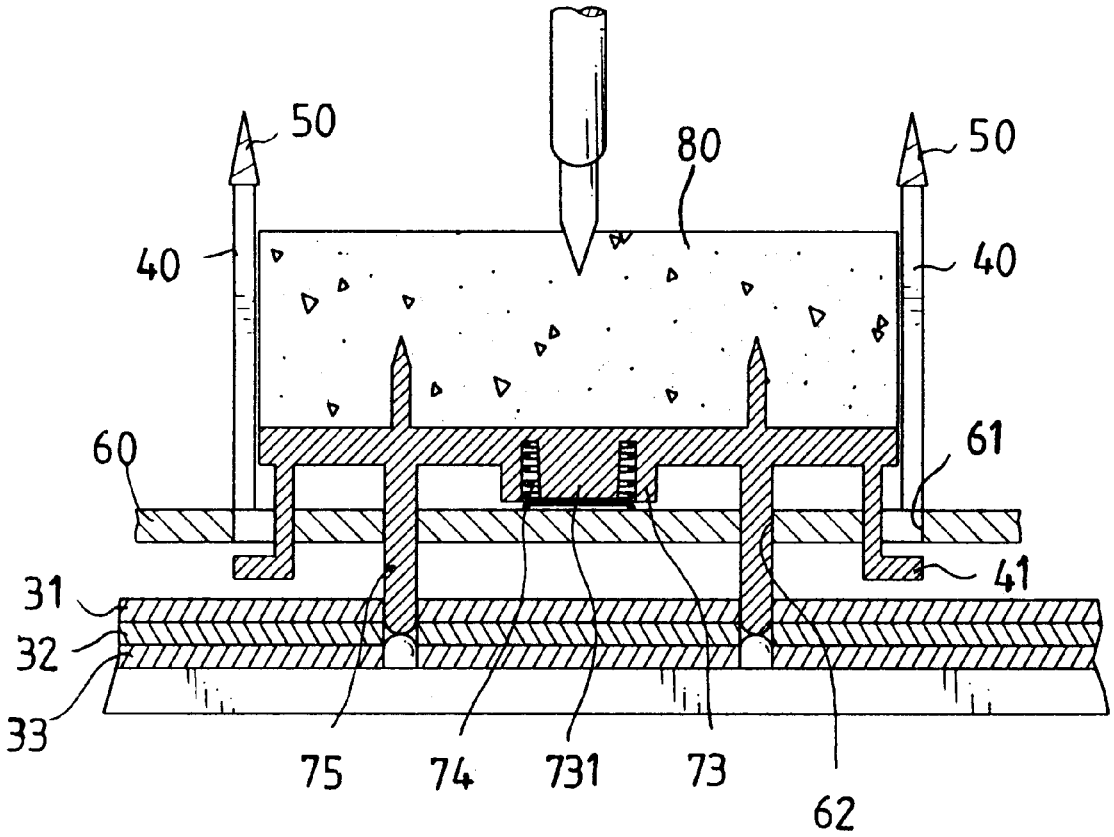

Referring next to FIGS. 3–6, the segments 70, 80 each includes a slide 70 slidably engaged in the scoring area 42 of the frame 40 and a soft block 80 secured to the slide 70. The soft blocks 80 may be made of cork, foamable material, plant fibers etc. The slides 70 each includes one or more pins 71 for engaging into the block 80 and for securing the block 80 to the slide 70. The block 80 may also be secured to the slide 70 by fasteners 710 (FIG. 5) or by adhesive material. The slides 70 each includes one or more legs 75 slidably engaging with the apertures 62 of the plate 60 and for guiding the relative sliding movement of the slides 70 relative to the plate 60. The slides 70 each includes one or more hooks 72 slidably engaged in the orifices 61 of the plate 60 for allowing the hooks 72 to engage through the orifices 61 and for allowing the hooks 72 to engage with the frame 40 and for limiting the outward movement of the slide 70 relative to the frame 40 (FIGS. 4, 6). The slides 70 each includes a hub 73 and a stud 731 provided in the hub 73 for defining an annular groove and for engaging with one end of a spring 74 (FIGS. 4–6) and for allowing the spring 74 to bias the slide 70 and the block 80 away from the plate 60 and outward of the frame 40. The slide 70 and the block 80 may be moved inward of the frame 40 against the springs 74 when the block 80 is shot by a dart 88 (FIG. 6).

Two silver ink imprinted conductor sheets 31, 33 are disposed between the frame 40 and the rear wall 110 and separated by a nonconducting and apertured sheet 32. Each silver ink imprinted conductor sheets 31, 33 includes a silver ink circuit having a series of silver ink switch points 310, 330 interconnected by a series of silver ink lines. The switch points 310, 330 of the two conductor sheets 31, 33 will be actuated to be contacted with each other by the legs 75 of the slides 70 (FIGS. 4–6). The sheet 32 includes a number of punctures 320 aligned with the switch points 310, 330 for allowing the switch points 310, 330 to be contacted with each other. The sheets 31, 33 include a suitable resilience such that the switch points 310, 330 may be separated from each other by the resilience of the sheets 31, 33. Without the springs 74, the legs 75 may also be spring back by the sheets 31, 33 after the block 80 is shot by the dart 88.

In operation, as shown in FIGS. 4 and 6, when the block 80 is shot by a dart 88, the slide 70 and the block 80 may both be forced inward of the frame 40 against the springs 74 and the resilience of the sheets 31, 33. The legs 75 may thus be caused to force the switch points 310, 330 of the sheets 31, 33 together and to send out a signal to a processing member disposed in the board 10 and for scoring purposes.

The slides 70 and the blocks 80 may be assembled without additional fasteners. The typical spider is provided for engaging with the segments 70, 80 and for preventing the segments from disengaging from the frame 40. The slides 70 of the present invention each includes one or more hooks 72 for engaging with the frame 40 and for limiting the outward movement of the slide 70 relative to the frame 40 (FIGS. 4, 6), such that no spider 50 is required. Furthermore, without the spider 50, the segments 70, 80 will not be blocked by the spider 50 such that the outer exposing area of the blocks 80 is greatly increased and such that the dart will have no change to be rebounded by the spider 50.

Figure 7:
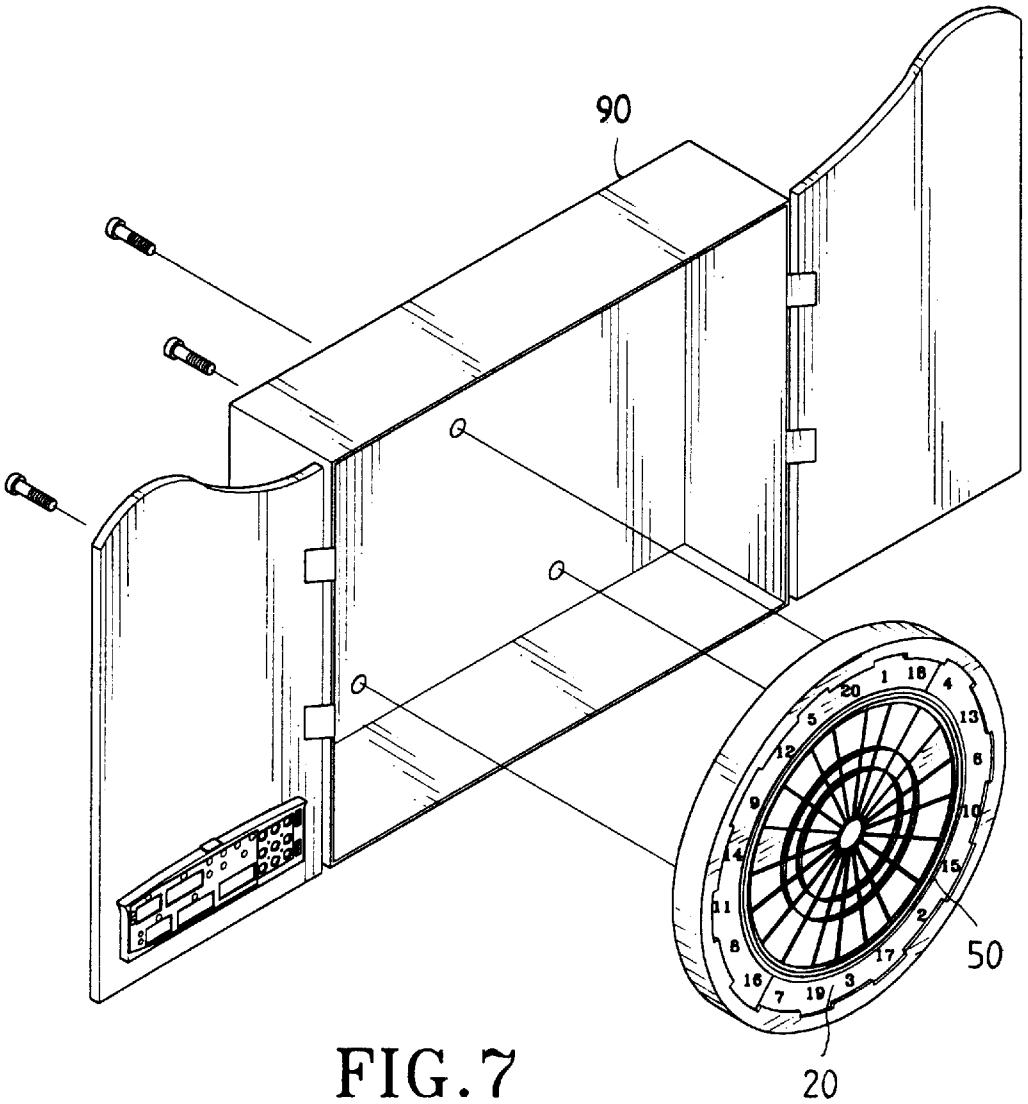
FIG. 7 is an exploded view illustrating an application of the electric dart game.
Figure 8:
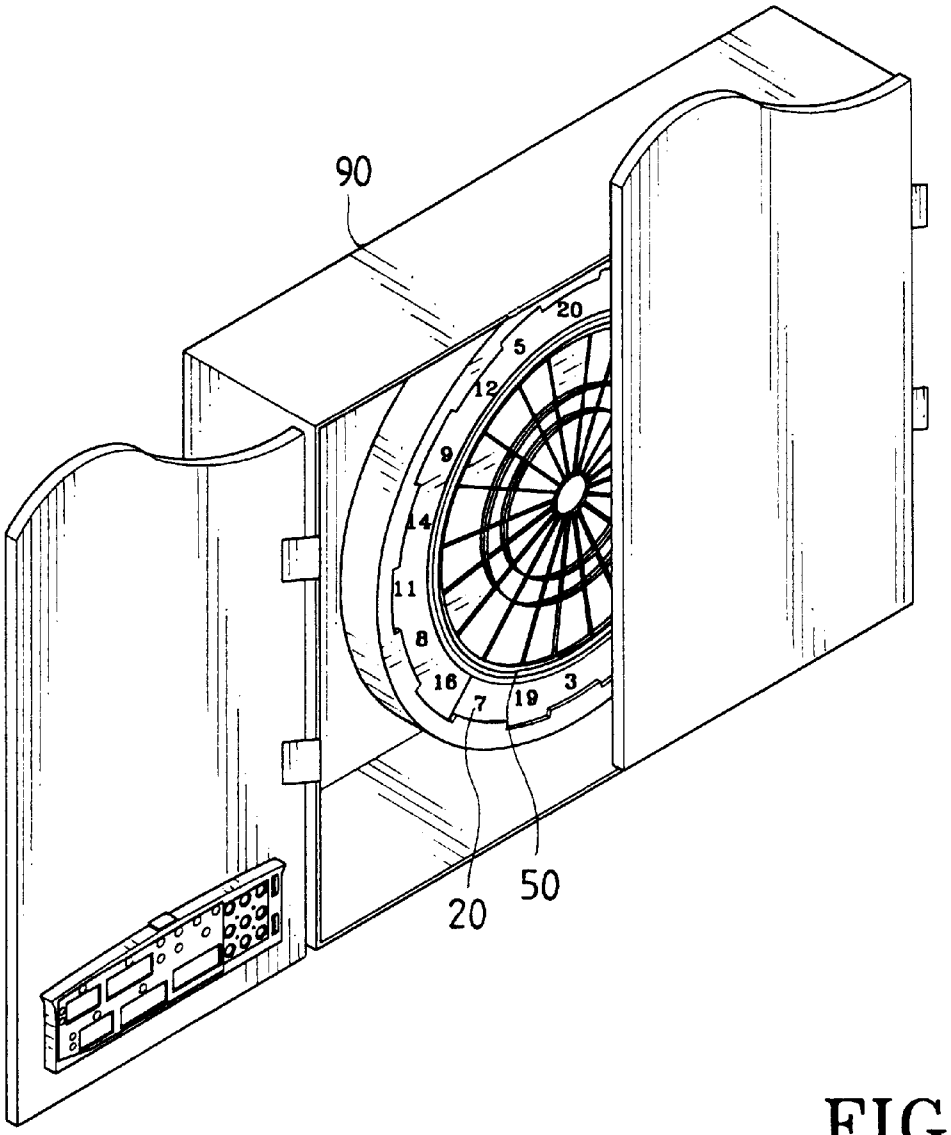
FIG. 8 is a perspective view illustrating the application of the electric dart game.

Referring next to FIGS. 7 and 8, a housing 90 may be provided for storing the electric dart game and for protecting the electric dart game from being damaged.

Accordingly, the electric dart game includes a number of segments that may be assembled without additional fasteners and without the spider.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An electric dart game comprising:

a board, said board further comprising an annular flange, a rear wall, and a plurality of displays at a bottom portion thereof;

a ring, having a plurality of score numbers thereon, and being secured to said board;

a frame, being provided with a plurality of scoring areas, and engaging with said annular flange on said board;

a plurality of segments, being slidably received in said plurality of scoring areas respectively;

a plate, being secured to a rear portion of said frame;

a first conductor sheet, having a plurality of switch points , and being disposed between said plate and said rear wall of said board;

a second conductor sheet, having a plurality of switch points corresponding to said switch points on said first conductor sheet, being disposed between said first conductor and said rear wall if said board; and a nonconductive sheet, having a plurality of apertures corresponding to said plurality of said switch points, and being placed between said two conductor sheets;

characterized in that said annular flange on said board having a plurality of notches and recesses in a radially peripheral portion thereof;

said frame having a plurality of projections extending radially outward to rotatably engage with said notches and recesses on said annular flange respectively;

said plate, being provided with a plurality of apertures corresponding to said switch points on said two conductor sheets and lining up said plurality of apertures in said nonconductive sheet, and being provided with a plurality of orifices; and each of said segments further comprising a slide with an outer face and an inward face, said inward face being adjacent said plate and being provided with at least a leg to pass through an accommodate one of said plurality of apertures in said plate and confront said conductor sheets, at least a hook slidably engaging with an accommodate one of said plurality of orifices in said plate, and a hub with a stud therein defining an annular groove;

a spring with two ends, one of said two ends being located at said annular groove, and the other one of said two ends contacting said plate; and a soft block, being attached to said outer face of said slide.

2. An electric dart game according to claim 1, wherein a spider is attached to said frame and has a plurality of openings communicating with said scoring areas in said frame.

3. An electric dart game according to claim 1, said board can be a circular shape and mounted in a housing.

4. An electric dart game according to claim 1, wherein said slide is provided integrally at least a pin at said outer face to be engaged with said soft block.

5. An electric dart game according to claim 1, wherein said soft block is attached to said slide by fasteners.

6. An electric dart game according to claim 1, wherein said soft block is attached to said slide by adhesives.

7. An electric dart game according to claim 1, wherein a spring with two ends is placed between said annular groove and said plate such that one of said two ends is located at said annular groove and the other one of said two ends contacts said plate.

* * * * *

UNITED STATES PATENT AND TRADEMARK OFFICE

CERTIFICATE OF CORRECTION

PATENT NO. : 6,089,571
DATED JULY 18, 2000
INVENTOR(S) : M. CHO

It is certified that error appears in the above-identified patent and that said Letters Patent is hereby corrected as shown below:

Col. 4, lines 34-36 where "a spring with two ends, one of said two ends being located at said annular groove, and the other of said two ends contacting said plate;" should be deleted.

Signed and Sealed this

First Day of May, 2001

*Attest:*

Nicholas P. Godici

NICHOLAS P. GODICI

*Attesting Officer*

*Acting Director of the United States Patent and Trademark Office*